US005221115A

United States Patent [19]

Takimoto

[11] Patent Number: 5,221,115

[45] Date of Patent: Jun. 22, 1993

[54] DOOR LOCK HANDLE ASSEMBLY FOR LEFTWARD AND RIGHTWARD PULLING DOORS

[75] Inventor: Kazuhide Takimoto, Tokyo, Japan

[73] Assignee: Takigen Manufacturing Co., Ltd., Tokyo, Japan

[21] Appl. No.: 905,810

[22] Filed: Jun. 29, 1992

[30] Foreign Application Priority Data

Jan. 16, 1992 [JP] Japan ..... 4-005310

[51] Int. Cl.[5] ..... E05C 3/30

[52] U.S. Cl. ..... 292/29; 292/216; 292/DIG. 46; 70/99

[58] Field of Search ..... 292/29, DIG. 46, 244, 292/118, 113, 216, 117; 70/99, 100, 210, 96, 95, 462, 97, 467, 483, 484, 485, 489

[56] References Cited

U.S. PATENT DOCUMENTS

| | | | |
|---|---|---|---|
| 2,530,330 | 11/1950 | Groeger | 292/29 |
| 2,821,422 | 1/1958 | Rainman | 292/DIG. 46 |
| 2,917,915 | 12/1959 | Rainman | 292/DIG. 46 |
| 3,198,564 | 8/1965 | Welsh | 292/DIG. 46 X |
| 4,457,146 | 7/1984 | Weinerman | 70/100 |
| 4,511,166 | 4/1985 | Weinerman | 292/29 |

FOREIGN PATENT DOCUMENTS

| | | | |
|---|---|---|---|
| 221597 | 5/1910 | Fed. Rep. of Germany | 70/99 |
| 249525 | 7/1912 | Fed. Rep. of Germany | 70/99 |
| 55864 | 10/1912 | Fed. Rep. of Germany | 292/DIG. 46 |
| 564287 | 11/1932 | Fed. Rep. of Germany | 292/29 |
| 476761 | 8/1915 | France | 70/99 |
| 727951 | 4/1932 | France | 292/31 |
| 99476 | 6/1923 | Switzerland | 70/99 |
| 376475 | 7/1932 | United Kingdom | 292/29 |

*Primary Examiner*—Rodney M. Lindsey
*Attorney, Agent, or Firm*—Martin Smolowitz

[57] ABSTRACT

A door lock handle assembly in which left and right latch members are rotatably supported on a pin, a sector lock member is secured to an operating shaft coupled to a rotor of a front unit and also to a stem shaft of a thumb knob, a lock projection is secured to a shoulder portion of the left latch member such that it is in contact with a left end portion of an arcuate edge of the sector lock member, a lock projection is secured to a shoulder portion of the right latch member such that it is in contact with a right end portion of the arcuate edge of the sector lock member, a drive member is secured to an interlock shaft coupled to shafts of front and rear handles, and a drive projection is secured to an arm of the drive member such that it is in contact with passive arms of the left and right latch members. The handle assembly can be used for both leftward and rightward pulling doors and permits manufacturing cost reduction by mass production of a single item product.

4 Claims, 3 Drawing Sheets

DOOR LOCK HANDLE ASSEMBLY FOR LEFTWARD AND RIGHTWARD PULLING DOORS

BACKGROUND OF THE INVENTION

1. Field of the Invention

This invention relates to a door lock handle assembly for both leftward and rightward pulling doors, for instance boat and yacht cabin entrance/exit doors.

2. Prior Art

Among the doors provided at the entrance/exit of boat and yacht cabins are those which are opened by turning them about a hinge axis, and those which are pulled along a straight guide rail. Among the pulling type doors are those of leftward pulling type, which are accommodated in a door accommodation section on the left side of an entrance/exit in the open state thereof, and those of rightward pulling type which are accommodated in a door accommodation section on the right side of an entrance/exit.

The prior art door lock handle assembly lacks versatility with respect to the leftward and rightward pulling doors. That is, a door lock handle assembly designed for a leftward pulling door and a door lock handle assembly designed for a rightward pulling door are not interchangeable. This means that two different kinds of door lock handle assemblies have to be fabricated and stocked independently to meet different demands, thus leading to extra stock space and making it difficult to reduce the cost of manufacture.

SUMMARY OF THE INVENTION

An object of the invention is to provide a door lock handle assembly which can be used for both leftward and rightward pulling doors, permits manufacturing cost reduction by mass production of a single item product, and permits stock space reduction with reduction of the stock items to one half.

According to the invention, there is provided a door lock handle assembly for both leftward and rightward pulling doors, which comprises a front case secured to the front surface of a door, a rear case secured to the rear surface of the door, a front handle having a stem end rotatably supported in a bearing of the front case, a rear handle having a stem end rotatably supported in a bearing of the rear case, a base member accommodated in the rear case and secured to the door, a front unit secured to the base member and also having a front end fitted in a through hole of the front case, a thumb knob having a stem shaft rotatably supported in a bearing of the rear case, an operating shaft supported in a bearing of the rear case, an operating shaft supported in a bearing of the rear case and coupled to the stem shaft of the thumb knob for rotation in unison with the thumb knob, a sector lock member having a stem secured to the operating shaft, a drive shaft secured to a rotor of the front unit and coupled to the operating shaft for rotation in unison with the operating shaft, a restoring spring provided between the rear case and the sector lock member and biasing the thumb knob to an unlocked position, a left latch member having a stem rotatably supported on a fixed pin secured to the rear case and also having a free end hook projecting through a left side opening of the rear case, a right member having a stem rotatably supported on the fixed pin and also having a front end hook projecting through a right side opening of the rear case, a lock projection secured to a shoulder of the left latch member and in contact with a left end portion of an arcuate edge of the sector lock member, a lock projection secured to a shoulder portion of the right latch member and in contact with a right end portion of the arcuate edge of the sector lock member, a restoring spring provided between the rear case and the left and right latch members and biasing the left and right latch members to a lock position, an interlock shaft rotatably supported on a rear case, shafts of the front and rear handles being fitted in or on the interlock shaft for rotation in unison with one another, a drive member secured to the interlock shaft and having an arm with a drive projection secured thereto for being in contact with passive arms of the left and right latch members, a restoring spring provided between the rear case and the drive member and biasing the drive member to a locked position, a key to be inserted in the front unit for turning the sector lock member to a locked position, a hook member provided in a left pillar wall of an entrance/exit and capable of engagement and disengagement with respect to the free end hook of the left latch member, and a second hook member provided in a right pillar wall of the entrance/exit and capable of engagement and disengagement with respect to the free end hook of the right latch member.

DETAILED DESCRIPTION OF THE INVENTION

Figure 1:
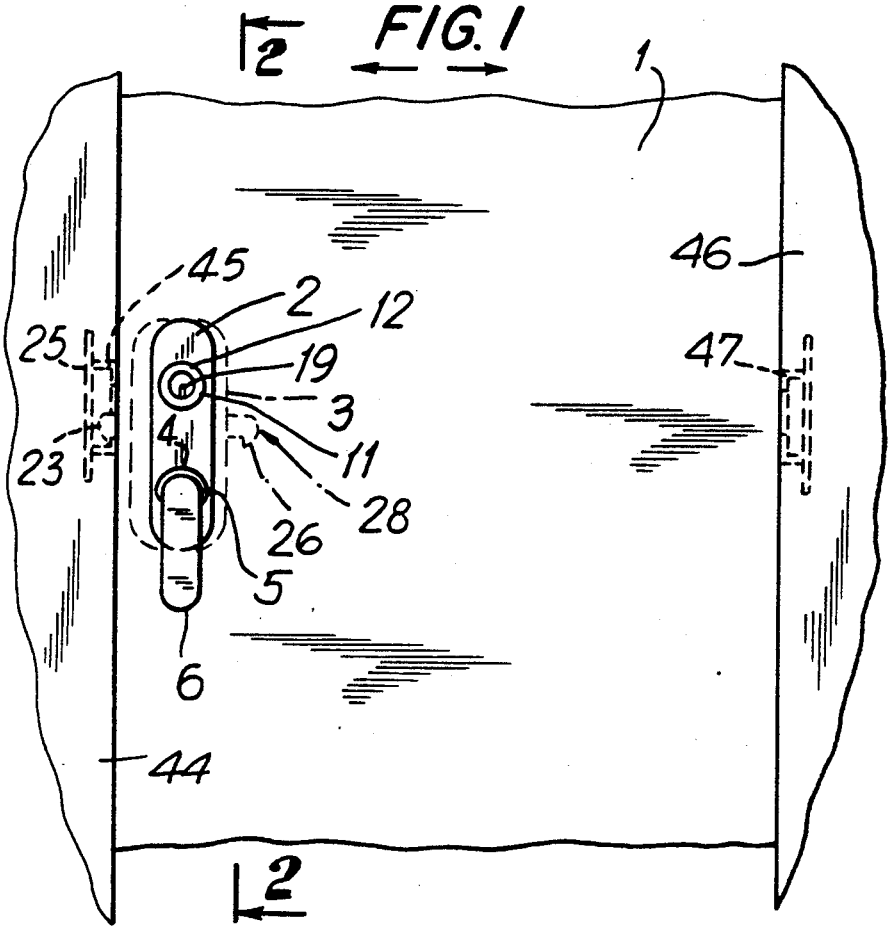
FIG. 1 is an elevational view showing an embodiment of the door lock handle assembly according to the invention and used for a rightward pulling, the door being shown closed.

Now, an embodiment of the invention will be described with reference to the accompanying drawings. The illustrated door lock handle assembly according to the invention comprises a front case 2 secured to the front surface of a door 1, a rear case 3 secured to the back surface of the door 1, a front handle 6 having a stem shaft 5 rotatably supported in a bearing 4 provided on the front case 2, a rear handle 9 having a stem end 8 rotatably supported in a bearing 7 provided on the rear case 3, a base member 10 accommodated in the rear case 3 and secured to the door 1, a front unit 12 secured to the base member 10 and having a front end portion fitted in a through hole 11 of the front case 2, a thumb knob 15 having a stem shaft 14 rotatably supported in a bearing 13 fitted on the rear case 3, an operating shaft 17 supported in a bearing 16 provided in the rear case 3 and coupled to the stem 14 of the thumb knob 15 for rotation together therewith, a sector lock member 18 having a stem secured to the operating shaft 17, and a drive shaft secured to a rotor 19 of the lock member 12 for rotation in unison with the operating shaft 17.

The door lock handle assembly further comprises a restoring spring 21 provided between the rear case 3 and sector lock member 18 and biasing the thumb knob 15 to be at an unlocked position, a left latch member 25 having a stem rotatably supported on a pin 22 secured to the rear case 3 and also having a free end hook 23 projecting from a left side opening 24 of the rear case 3, a right latch member 28 having a stem rotatably supported on the pin 22 and a free end hook 26 projecting from the right opening 27 of the rear case 3, a lock projection 30 projecting from a shoulder portion of the left latch member 25 and in contact with a left end portion of an arcuate edge 29 of the sector lock member 18, a lock projection 31 projecting from a shoulder portion of the right latch member 28 and in contact with a right end portion of the arculuate edge of the sector lock member 18 and a spring 32 provided between the rear case 3 and left latch and right members 25 and 28 and biasing the left right latch members 25 and 28 to be at locked positions.

Figure 4:
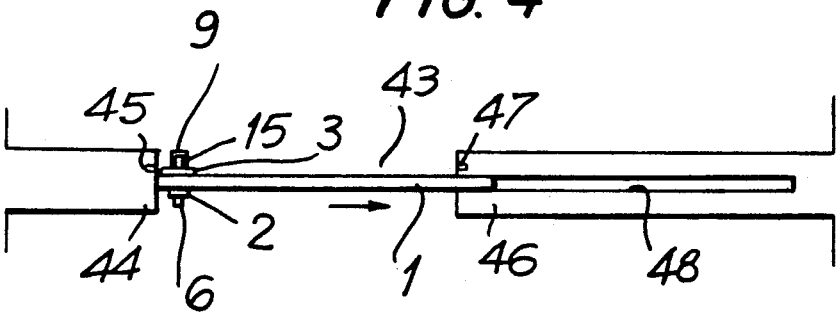
FIG. 4 is a schematic plan view showing a rightward pulling door using the door lock handle assembly in a closed state.
Figure 3:
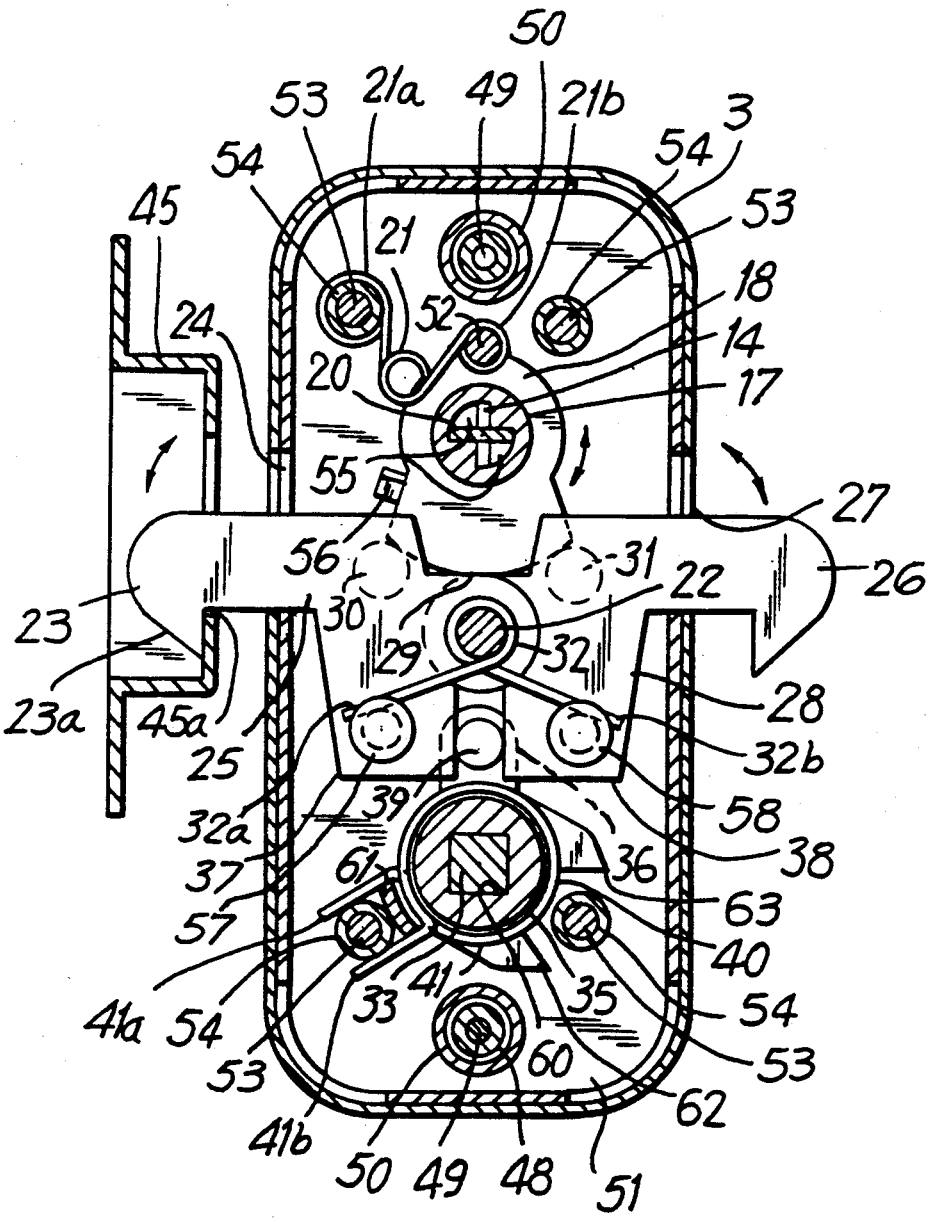
FIG. 3 is a sectional view taken along 3—3 in FIG. 2.

The door lock handle assembly further comprises an interlock shaft 35 rotatably supported in the rear case 3 such that a shaft 33 of the front handle 6 and a shaft 34 of the rear handle 9 are rotated in unison with each other, a drive member 40 and having an arm 36 with a drive projection in contact with a passive arm 37 of the left latch member 25 and a passive arm 38 of the right latch member 28, a restoring spring 41 provided between the rear case 3 and a drive member 40 and biasing the drive member 40 to be at a locked position, the key 42 to be inserted in a lock unit 12 and turned to bring the sector lock member 18 to the locked position, a hook member 45 provided in a left pillar wall 44 at an entrance/exit and being engaged and disengaged by the front end hook 23 of left latch member 25, and a hook member 47 provided in a right pillar wall 46 of the entrance/exit and being engaged and disengaged by the front end hook 26 of the right latch member 28.

Where the door lock handle assembly is used for a rightward pulling type door, as shown in FIGS. 1 and 4, by moving the door 1 from accommodation section 48 to the left by gripping the front or rear handle 6 or 9 to close the entrance/exit 43, at the end of the closing operation the arcuate cam face 23*a* of the front end hook 23 is moved in frictional contact with the opening edge 45*a* of the hook member 45 in the clockwise direction in FIG. 3. When the door 1 reaches its fully closed position, it is in contact with the left pillar wall 44. At this time, the left latch member 25 passes by the opening edge 45*a* of the hook member 45, whereby the left latch member 25 is rotated in the counterclockwise direction by the biasing force of the spring 32 to engage with the free end hook 23 and hook member 45. The engagement between the free end hook 23 and hook member 45 is maintained by the biasing by the spring 32, and thus the door 1 is held in the closed position.

If it is desired to lock the closed door 1 from the front side, the key 42 is inserted into the rotor 19 of the lock unit 12 of the front case 2 and turned so as to turn the operating shaft 17 via the interlock shaft 20 in the clockwise direction in FIG. 3, thus bringing a left end portion of the arcuate edge 27 of the sector lock member 18 into contact with the lock projection 30 of the right latch member 28. If it is desired to lock the door 1 from the back side, the thumb knob 15 is turned so as to turn the operating shaft 17 via the stem shaft 14 in the same direction, thus bringing a left end portion of the arcuate edge 29 of the sector lock member 18 into contact with the lock projection 30. As a result, the left latch member 25 can no longer be turned in the clockwise direction, that is, the door 1 is locked in the closed position and can no longer be opened turning the front or rear handle 6 or 9.

A person who wants to open the door 1 from the front side thereof, first releases the lock by the lock unit 12 of the front case 2 if the lock has been made, and then turns the interlock shaft 35 in the counterclockwise direction in FIG. 3 by gripping the front handle 6. If the lock has not been made, the person immediately turns the interlock shaft. With this turning operation, the drive projection 39 of the drive member 40 pushes the passive arm 37, thus turning the left latch member 28 in the clockwise direction. In this way, the engagement between the free end hook 23 and hook member 45 is released. By pulling the front handle 6 to the left, the door 1 is separated from the right pillar wall 45, and then is accommodated in a door accommodation section in the right pillar wall 46. The entrance/exit 43 is thus opened.

Figure 5:
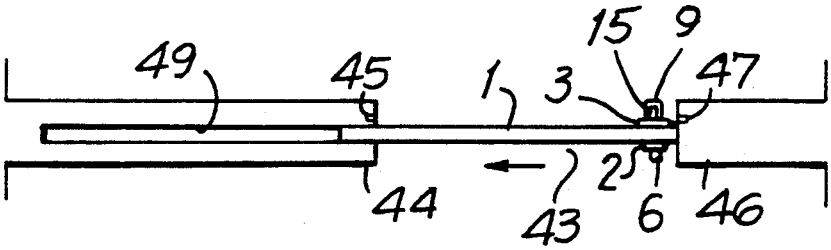
FIG. 5 is a schematic plan view showing a leftward pulling door using the door lock handle assembly in a closed state.
Figure 2:
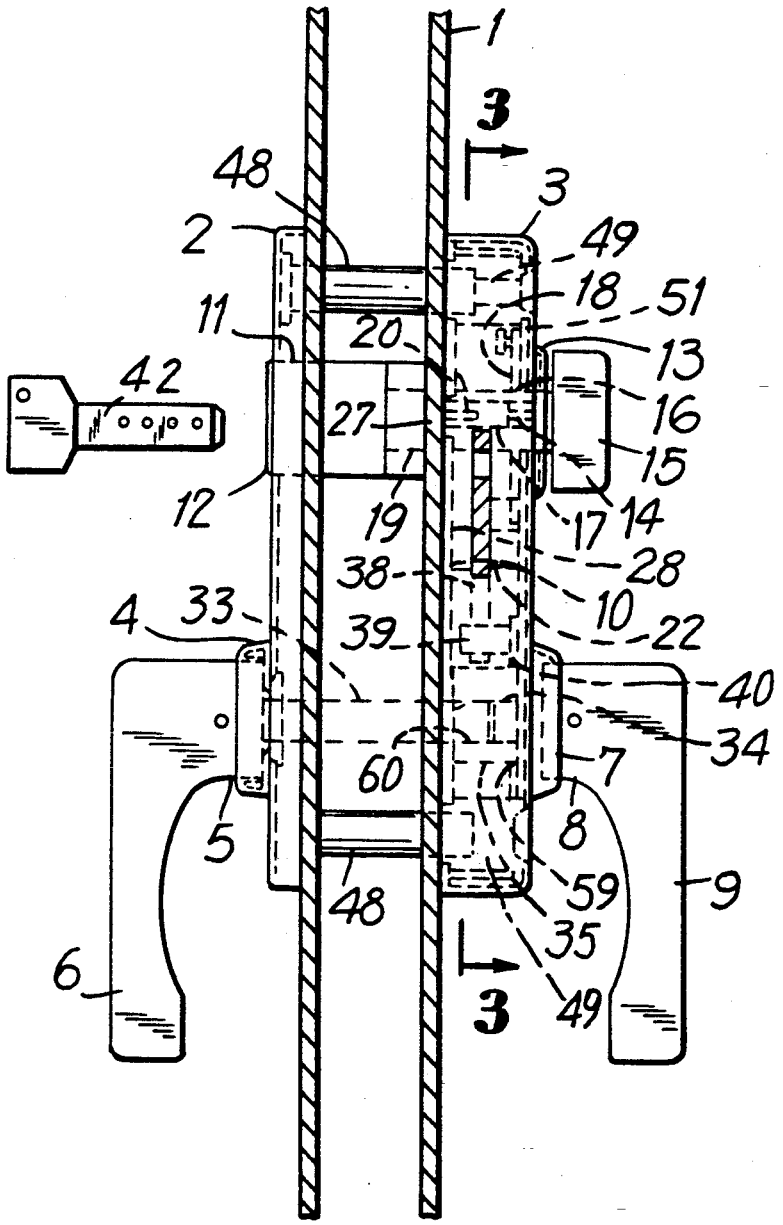
FIG. 2 is a sectional view taken along 2—2 in FIG. 1.

A person who wants to open the door 1 from the back side, first releases the lock by the thumb knob 15 if the lock has been made, and then turns the interlock shaft 35 in the counterclockwise direction in FIG. 3 by gripping the rear handle 9. If the lock has not been made, the person immediately turns the interlock shaft. With this turning operation, the drive projection 39 of the drive member 40 pushes the passive arm 37 to turn the left latch member 25 in the clockwise direction. As a result, the engagement between the free end hook 23 and hook member 45 is unlocked. By pulling the rear handle 9 directly, the door 1 is separated from the left pillar wall 44 and accommodated in the door accommodation section 48 in the right pillar wall 46. The entrance/exit 43 is thus opened.

Where the door lock handle assembly is used for a leftward pulling type door as shown in FIG. 5, at the end of the operation of closing the door 1, the free end hook 26 of the right latch member 28 engages with the hook member 47 in the right pillar wall 46. Further, at the end of the operation of opening the door 1 the free end hook 23 of the left latch member 25 engages with the hook member 45 of the left pillar wall 44, and the door 1 is accommodated in the door accommodation section 49 in the left pillar wall 44. The operations of opening and closing the door 1 and locking operation are done in the manners similar to those in the case where the door lock handle assembly is used for the rightward pulling door.

In the illustrated embodiment, the front and rear cases 2 and 3 are secured to the door 1 by screwing a screw 49 into a cylindrical boss 48 secured to the front case 2 from the side of the rear case 3. A support member 51 is fitted in and secured to the rear end of the rear case 3. The bearing 16 of the operating shaft 17 is constituted by a through hole formed in the support member 51. The sector lock member 18 is fitted in and welded to an intermediate portion of the operating shaft, and it is provided at its position opposite the arcuate edge 29 with a spring retainer projection 52 secured to it. The base member 10 is fitted in the front end of the rear case 3 and secured thereto by a screw 53 screwed into a cylindrical boss 48 secured to the support member 51. A cylindrical spacer 50 is fitted on the cylindrical boss 48 and screw 49. The restoring spring 21 is constituted by a torsion spring having one end 21*a* fitted on the cylindrical boss 54 and the other end 21*b* fitted on the spring retainer projection 52.

In this embodiment, two operating shafts 17 are provided such that they extend axially and symmetrically with each other with respect to a sector-shaped receiving groove 55 with an opening angle of 90 degrees. A cross-shaped front end of the stem shaft 14 of the thumb knob 15 is fitted in a rear portion of the receiving groove 55, and a flat rear end of the drive shaft 20 is fitted in a front portion of the receiving groove 55. The support member 51 is provided with a stopper projection 56 for stopping the sector lock member 18 at the lock position. The pin 22 is welded to the support member 51, and the restoring spring 32 constituted by a torsion spring is fitted on the pin 22. The spring 32 has a straight end portion 32*a* in engagement with a spring retainer projection 57 secured to the passive arm 37 of the left latch member 25, and has the other straight end portion 32*b* in engagement with a spring retainer projection 58 secured to the passive arm 38 of the right latch member 28.

The drive member 40 is welded to the rear end of the interlock shaft 35, which is in turn fitted in a bearing hole 59 of the support member 51. The shafts 33 and 34 of the front and rear handles 6 and 9 are fitted in the central rectangular hole 60 of the interlock shaft 35, and torque of the front and rear handles 6 and 9 is transmitted to the drive member 40. The restoring spring 41 is fitted on the interlock shaft 35, and the straight end portions 41*a* and 41*b* of the spring 41 are in contact with a raised portion 61 of the drive member 40 and cylindrical boss 54. The drive member 40 has its periphery provided with stopper projections 62 and 63 to be engaged and disengaged with respect to the opposite side cylindrical boss 54, and the rotational angle of the front and rear handles 6 and 9 is restricted to a predetermined angle by the contact of the stopper projections 62 and 63 with the cylindrical boss 54.

As has been described in the foregoing, with the door lock handle assembly according to the invention, the left and right latch members 25 and 28 are rotatably supported on the fixed pin 22, the operating shaft 17, to which the rotor 19 of the front unit 12 and stem shaft 14 of the thumb knob 15, is secured to the sector lock member 18, the lock projection 30 in contact with a left end portion of the arcuate edge 29 of the sector lock member 18 is secured to a shoulder portion of the left latch member 25, the lock projection 31 in contact with a right end portion of the arcuate edge 29 of the sector lock member 18 is secured to a shoulder portion of the right latch member 28, the drive member 40 is secured to the interlock shaft 35 coupled to the shafts 33 and 34 of the front and rear handles 6 and 9, and the passive arms 37 and 38 of the left and right latch members 25 and 28 are secured to the arm 36 of the drive member 40. Thus, the door lock handle assembly may be used for both the leftward and rightward pulling doors without need of alteration of assembling or any additional part. It is thus possible to reduce manufacturing cost by reduction of the stock space needed and with reduction of stocked items.

I claim:

1. A door lock handle assembly for both leftward and rightward pulling doors comprising a front case for securing to the front surface of the door, a rear case for securing to the rear surface of said door, a front handle having a stem end rotatably supported in a bearing of said front case, a rear handle having a stem end rotatably supported in a bearing of said rear case, a base member accommodated in said rear case for securing to said door, a front unit secured to said base member and also having a front end fitted in a through hole of said front case, a thumb knob having a stem shaft rotatably supported in a bearing of said rear case, an operating shaft supported in a bearing of said rear case and coupled to said stem shaft of said thumb knob for rotation in unison with said thumb knob, a sector lock member having a stem secured to said operating shaft, a drive shaft secured to a rotor of said front unit and coupled to said operating shaft for rotation in unison with said operating shaft, a restoring spring provided between said rear case and said sector lock member and biasing said thumb knob to an unlocked position, a left latch member having a stem rotatably supported on a fixed pin secured to said rear case and also having a freed end hook projecting through a left side opening of said rear case, a right latch member having a stem rotatably supported on said fixed pin and also having a front end hook projecting through a right side opening of said rear case, a lock projection secured to a shoulder of said left latch member and in contact with a left end portion of an arcuate edge of said sector lock member, a lock projection secured to a shoulder portion of said right latch member and in contact with a right end portion of said arcuate edge of said sector lock member, a restoring spring provided between said rear case and said left and right latch members and biasing said left and right latch members to a locked position, an interlock shaft rotatably supported on the rear case, shafts of said front and rear handles being interfitted with said interlock shaft for rotation in unison with one another, a drive member secured to said interlock shaft and having an arm with a drive projection secured thereto for being in contact with passive arms of said left and right latch members, a restoring spring provided between said rear case and said drive member and biasing said drive member to a locked position, a key to be inserted in said front unit for turning said sector lock member to a locked position a hook member for provision in a left pillar wall of an entrance/exit and capable of engagement and disengagement with respect to said free end hook of said left latch member, and a second hook member for provision in a right pillar wall of said entrance/exit and capable of engagement and disengagement with respect to said free end hook of said right latch member.

2. A lock handle assembly according to claim 1, wherein said base member is fitted into a front end of said rear case and is secured to a support member which is fitted into a rear end of said rear case and contains said bearing, with said restoring spring being retained on a cylindrical boss in said rear case.

3. A lock handle assembly according to claim 1, wherein said operating shaft includes two shafts extending axially with each other and contain a sector-shaped receiving groove having an opening angle, with said thumb knob being fitted into a rear portion of said receiving groove, and a rear end of said drive shaft is fitted in a front portion of said receiving groove.

4. A lock handle assembly according to claim 2, wherein said drive member is supported with a bearing in said support member and includes dual stopper projections which are engaged and disengaged with opposite sides of a boss secured to said rear case, so as to provide a predetermined angle of rotation for said front and rear handles.

* * * * *